US007345264B2

(12) United States Patent
Yoshidome

(10) Patent No.: US 7,345,264 B2
(45) Date of Patent: Mar. 18, 2008

(54) BUILT-IN KITCHEN APPARATUS

(75) Inventor: Akihiro Yoshidome, Osaka-fu (JP)

(73) Assignee: Sharp Kabushiki Kaisha, Osaka (JP)

( * ) Notice: Subject to any disclaimer, the term of this patent is extended or adjusted under 35 U.S.C. 154(b) by 38 days.

(21) Appl. No.: 11/335,408

(22) Filed: Jan. 19, 2006

(65) Prior Publication Data

US 2006/0191923 A1 Aug. 31, 2006

(30) Foreign Application Priority Data

Feb. 15, 2005 (JP) ..... 2005-037475

(51) Int. Cl.
*H05B 6/80* (2006.01)

(52) U.S. Cl. ..... 219/756; 219/757

(58) Field of Classification Search ..... 219/756, 219/757, 758, 752, 753, 754, 734, 385, 521; 432/239, 121, 153; 414/147, 150, 153
See application file for complete search history.

(56) References Cited

U.S. PATENT DOCUMENTS 4,335,292 A * 6/1982 Tanaka et al. ..... 219/754
6,660,984 B1 * 12/2003 Jeong et al. ..... 219/757
6,737,622 B1 * 5/2004 Jeong et al. ..... 219/756

FOREIGN PATENT DOCUMENTS

| | | |
|---|---|---|
| JP | 11-118160 | 4/1999 |
| JP | 2002-228163 | 8/2002 |
| JP | 2003-148744 | 5/2003 |

* cited by examiner

*Primary Examiner*—Quang Van
(74) *Attorney, Agent, or Firm*—Renner, Otto, Boisselle & Sklar, LLP

(57) ABSTRACT

When a cooking apparatus body, such as a microwave oven, is installed in a kitchen cabinet, a power cord connected to a commercial power source from the back of the kitchen cabinet is folded and stored in a storage space provided between a shelf section, which is provided as part of an upper wall of the cooking apparatus body, and a ceiling section of the kitchen cabinet by the rigidity of the power cord. Since the power cord is not caught between a rear wall of the cooking apparatus body and a back wall of the kitchen cabinet, the depth of the cooking apparatus body can be increased.

6 Claims, 7 Drawing Sheets

BUILT-IN KITCHEN APPARATUS

The present application is based on and claims priority of Japanese patent application No. 2005-037475 filed on Feb. 15, 2005, the entire contents of which are hereby incorporated by reference.

BACKGROUND OF THE INVENTION

1. Field of the Invention

The present invention relates to a built-in kitchen apparatus such as a microwave oven, an electric oven, or a dish washing and drying machine, that is installed in furniture or a cabinet as an independent apparatus or a component of composite cooking apparatus.

2. Description of the Related Art

Known cooking apparatuses, such as a microwave oven, having a cover for opening and closing the front of the apparatus have been proposed. In addition to such cooking apparatuses, a pull-out cooking apparatus that can be pulled out forward has been proposed. Since such a pull-out cooking apparatus is suitable for a relatively large structure, the apparatus is provided as one of a cooking apparatus constituting an integrated kitchen system. Recently, as a result of kitchens being increased in size and formed as systems, diversification and unitization of cooking apparatuses have been promoted. Accordingly, a built-in apparatus configured by combining a cooktop, a pull-out microwave oven, an electric oven, and the like has been proposed.

An example of a built-in cooking apparatus is illustrated in FIGS. 6 and 7. FIG. 6 is a perspective view illustrating an example of a known built-in cooking apparatus. FIG. 7 is a side view of the built-in cooking apparatus shown in FIG. 6. As shown in FIGS. 6 and 7, the built-in cooking apparatus includes a cooking apparatus body 1 having an overall shape of a rectangular shape, a cover 2 including a drawer body, which can be pulled out from the cooking apparatus body 1, and being disposed at the front surface of the cooking apparatus body 1 so that a heating chamber 6 can be closed, an operation panel 3 disposed at the front of the cooking apparatus body 1 and above the cover 2, and a power cord 4 extending from the back of the cooking apparatus body 1. The cooking apparatus is a built-in apparatus is installed inside a kitchen cabinet 5 in a manner such that the upper surface is a cooking top 5*a*, as shown in FIG. 7. Since the operation panel 3 according to this example is provided as a single unit with the cooking apparatus body 1, the cover 2 is pulled out separately from the operation panel 3.

A cooking apparatus, such as a microwave oven, that uses electricity requires a power cord extending from the cooking apparatus to be connected to a power outlet so as to obtain electric power from a power supply, such as a commercial power supply. Since the built-in cooking apparatus is surrounded by other cooking apparatuses and a chassis, the power cord must be handled with caution. More specifically, as shown in FIGS. 6 and 7, since the power cord 4 is connected to a back surface 1*a* of the cooking apparatus body 1, when, in particular, the cooking apparatus is to be installed from the front side, the power cord 4 has to have a length that corresponds to at least the depth of the cooking apparatus body 1, i.e., the length from the back surface 1*a* of the cooking apparatus body 1, which is disposed at an installation preparation position, to a connecting unit 7, which is disposed on the back of the kitchen cabinet 5. When the cooking apparatus is to be installed, the power cord 4 having such a length and being in a substantially straight state is bent and folded and then stored in a space 8 provided at the back of the cooking apparatus body 1.

When the cooking apparatus body 1 is to be installed in the kitchen cabinet 5, the power cord 4 is easily caught between the cooking apparatus body 1 and the kitchen cabinet 5. For this reason, installation of the cooking apparatus body 1 may be difficult, and, moreover, in some cases, the power cord 4 may be damaged. To avoid such incidents, the space 8 provided between the back surface 1*a* of the cooking apparatus body 1 and the kitchen cabinet 5 has to be increased. However, in such a case, by increasing the space 8, the depth of the heating chamber 6 will be decreased by the same amount. As a result, it becomes difficult to provide sufficient cooking space for the heating chamber 6.

A built-in cooking apparatus known as an integrated kitchen system may include a built-in cooking heater installed on the upper surface, i.e., counter top, of the cabinet and a heat controller capable of controlling the heat generated at the cooking heater installed on the cabinet panel. When the cooking heater and the heat controller are installed in the cabinet of the integrated kitchen system with fasteners, setscrews, wood screws, and installation screws, many installation fixings and complicated installation work are required. Therefore, for example, an attachment structure is provided on the heat controller, allowing the heat controller to be inserted and fixed with a simple one-touch operation of inserting a switch casing into an attachment hole on the panel of the cabinet, so that fixing springs provided on the left and right side surfaces of the switch casing latch with the edge of the attachment hole (refer to Japanese Unexamined Patent Application Publication No. 11-118160, paragraph [0022], FIG. 1). According to this attachment structure, wood screws and other screws for installation can be omitted and the number of fixings and man-hour required for installation can be reduced. Wiring cords of the body of the working heater and the heater controller are connected via a connector. To connect the heat controller to a commercial power source with a power cord, a power plug must be inserted into a socket. Since the heat controller has a built-in structure, complicated installation work is required for the power cord. However, this is not mentioned in the patent document referred to above.

In general, a built-in microwave oven installed in furniture must be equipped with a three-wire round cord that complies with a high safety standard. However, for counter-top microwave oven, a three-wire flat cord complying with a lower safety standard is satisfactory. Therefore, the cords cannot be used for both types of microwave ovens. When a microwave oven is configured as a counter-top microwave oven including a flat three wire power cord but is used as built-in, an adaptor box may be used (refer to Japanese Unexamined patent Application Publication No. 2002-228163, paragraphs [0038] to [0041], FIG. 7). An adaptor box is constituted of a box having an L-shaped side view. A three-wire round power cord is attached to the exterior at a predetermined position on the outer surface. The attachment portion of the three-wire round power cord includes a connector for electrically coupling a three-wire flat power cord. When a counter-top microwave oven is used as a built-in microwave oven, the adaptor box is use to store the three-wire flat power cord provided for the microwave oven in a manner such that the cord is hidden from the outside and to couple the three-wire flat power cord with the three-wire round power cord stored in the adaptor box via a connector. By employing such a structure, a counter-top microwave oven can be used as a built-in microwave oven.

When the microwave oven is disposed and used in a location other than the kitchen cabinet and when cooking is carried out simultaneously at the kitchen cabinet and the microwave oven, the cook must move a great between the kitchen cabinet and microwave oven and the appearance becomes unattractive since the microwave oven is directly exposed to the outside. Moreover, installation space is required for disposing the microwave oven, and, as a result, the space available for the kitchen is reduced. Accordingly, a built-in cooking apparatus including a microwave oven having a slide-out tray interposed between the upper stove and the cabinet has been proposed so as to decrease the volume of the cooking chamber in order to increase the lower space of the microwave oven. In this way, a storage cabinet can be disposed, the object to be cooked can be easily taken out and put in, and cooking with the stove and the microwave oven can be simultaneously carried out. As a result, work efficiency is improved and the work load borne by the cook is reduced (refer to Japanese Unexamined Patent Application Publication No. 2003-148744, paragraphs [0003] and [0008] to [0010], FIGS. 1 and 2). When the microwave oven is disposed in a location other than the kitchen cabinet, if the position of the power outlet is unsuitable for inserting the power cord, known problems such as the power cord being exposed and an extension cord being required occur. However, for a built-in cooking apparatus, no descriptions on the positioning and the handling of the power cord during installation have been provided in the patent document referred to above.

Accordingly, for a built-in kitchen apparatus to be installed in furniture or a cabinet as an independent apparatus or a component of a composite cooking apparatus, there are problems to be solved in order to safely and efficiently store a power cord by using the rigidity of the power cord itself during installation of a kitchen apparatus body in the furniture or cabinet.

SUMMARY OF THE INVENTION

The present invention provides a built-in kitchen apparatus that does not require a space for preventing a power cord from being caught between the back area of the kitchen apparatus body and a kitchen apparatus body to be provided in advance and does not require a special operation for preventing the power cord from being caught during installation of the kitchen apparatus body in the cabinet. Moreover, the built-in kitchen apparatus according to the present invention allows the installation operation to be carried out easily and quickly and includes a heating chamber having a great depth.

To solve the above-identified problems, the present invention provides a built-in kitchen apparatus including a kitchen apparatus body capable of accommodating an object to be processed, and a power cord extending from the kitchen apparatus body, the power cord being capable of supply electric power used for processing the object to be processed, wherein the kitchen apparatus body is installed inside a cabinet and a storage space configured to accommodate the power cord between an upper wall of the kitchen apparatus body and a ceiling section of the cabinet.

According to the built-in kitchen apparatus according to the present invention, unlike a known built-in kitchen apparatus, when the kitchen apparatus body is installed in the cabinet, the power cord connected to a commercial power source from the rear of the cabinet is not caught between the rear wall of the kitchen apparatus body and the back wall of the cabinet and is neatly stored in the storing space by the rigidity of the power cord. Since the power cord is not stored in the back area of the kitchen apparatus body, the kitchen apparatus body can have a great depth. After the kitchen apparatus body is installed, the object to be processed can be stored in the kitchen apparatus body and processing on the object can be carried out by the electrical power supplied through the power cord.

According to the built-in kitchen apparatus according to the present invention, to maintain a large storage space for accommodating the object to be processed in the kitchen apparatus body, it is preferable to provide a wide storage space in the center of the kitchen apparatus body. Accordingly, a shelf section may be provided at at least one corner on a side of the upper wall, and the storage space may be provided between the ceiling section and the shelf section. By employing these positions and structures, a large space for accommodating an object to be processed is provided in the center of the kitchen apparatus body, and the power cord can be efficiently stored in the storage space provided on the shelf section and between the ceiling section of the cabinet and the kitchen apparatus body.

It is preferable that the power cord is extended upwards from the kitchen apparatus body from a rear position of the upper wall. If the power cord hangs downward at the back area of the kitchen apparatus body when installing the kitchen apparatus body, it becomes difficult to store the power cord in the storage space provided between the rear wall of the kitchen apparatus body and the back wall of the cabinet. Therefore, positions and structures in which the power cord extends upwards from the kitchen apparatus body at a rear position of the ceiling section are employed. According to such positions and structures, the length of the power cord extending to the back wall of the cabinet when the kitchen apparatus body is disposed at the installation position can be minimized. When the kitchen apparatus body is installed, the power cord extending upwards from ceiling section to the real wall of the kitchen apparatus body by the rigidity of the power cord is folded in two at substantially the center of the cord and is efficiently stored in the storage space in a neatly folded state. In this way, the storage space can be used efficiently for accommodating the power cord. By providing a shelf section having a step-like structure on the ceiling section, the space having a step-like structure can be efficiently used.

The above-described built-in kitchen apparatus may be a pull-out microwave oven including a drawer body having a heating chamber, wherein the drawer body can be pulled out forward. Furthermore, the kitchen apparatus may be a composite kitchen apparatus including a pull-out microwave oven including a drawer body having a heating chamber, wherein the drawer body can be pulled out forward. By providing a storage space for accommodating the power cord in an independent pull-out microwave oven or the pull-out microwave oven of a composite kitchen apparatus, a large space may be provided for the heating chamber of the microwave oven of the independent pull-out microwave oven or the pull-out microwave oven of the composite kitchen apparatus.

The built-in kitchen apparatus according to the present invention, a shelf section is provided at at least one corner on a side of the upper wall, the storage space is provided between the ceiling section and the shelf section, the kitchen apparatus is a pull-out processing device including a drawer body having a processing chamber or a composite kitchen apparatus including a pull-out processing device including a drawer body, which can be pulled out forward, having a heating chamber, and a space provided below the shelf section of the kitchen apparatus body is used as a passage box configured to accommodate one of a sliding mechanism for pulling out the drawer body. According to these structures and positions, the space below the shelf section of the cooking apparatus body will not be dead space and may be efficiently used as a passage box configured to accommodate one of the sliding mechanisms used for pulling out the drawer body. As a result, the space of the processing chamber may be maximized.

According to the built-in kitchen apparatus according to the present invention, as described above, since a storage space for accommodating the power cord between an upper wall of the kitchen apparatus body and a ceiling section of the cabinet is provided, the built-in kitchen apparatus does not require a space for preventing a power cord to be caught between the back area of the kitchen apparatus body and a kitchen apparatus body to be provided in advance. Moreover, the kitchen apparatus according to the present invention does not require a special operation for preventing the power cord from being caught during installation of the kitchen apparatus body in the cabinet. Moreover, the kitchen apparatus allows the installation operation to be carried out easily and quickly and provides a kitchen apparatus body having a great depth, allowing an object having a large volume to be disposed in the kitchen apparatus body for processing.

DESCRIPTION OF THE PREFERRED EMBODIMENTS

A built-in kitchen apparatus according to an embodiment of the present invention will be described with reference to the drawings.

Figure 6:
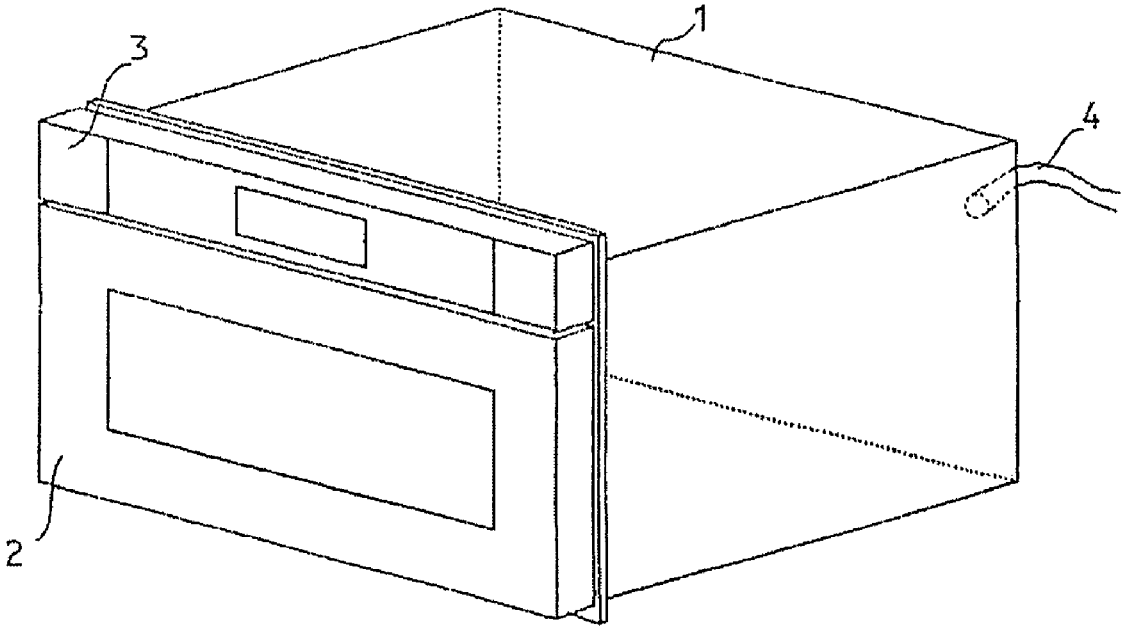
CONVENTIONAL ART FIG. 6
FIG. 6 is a perspective view illustrating a known built-in kitchen apparatus.
Figure 7:
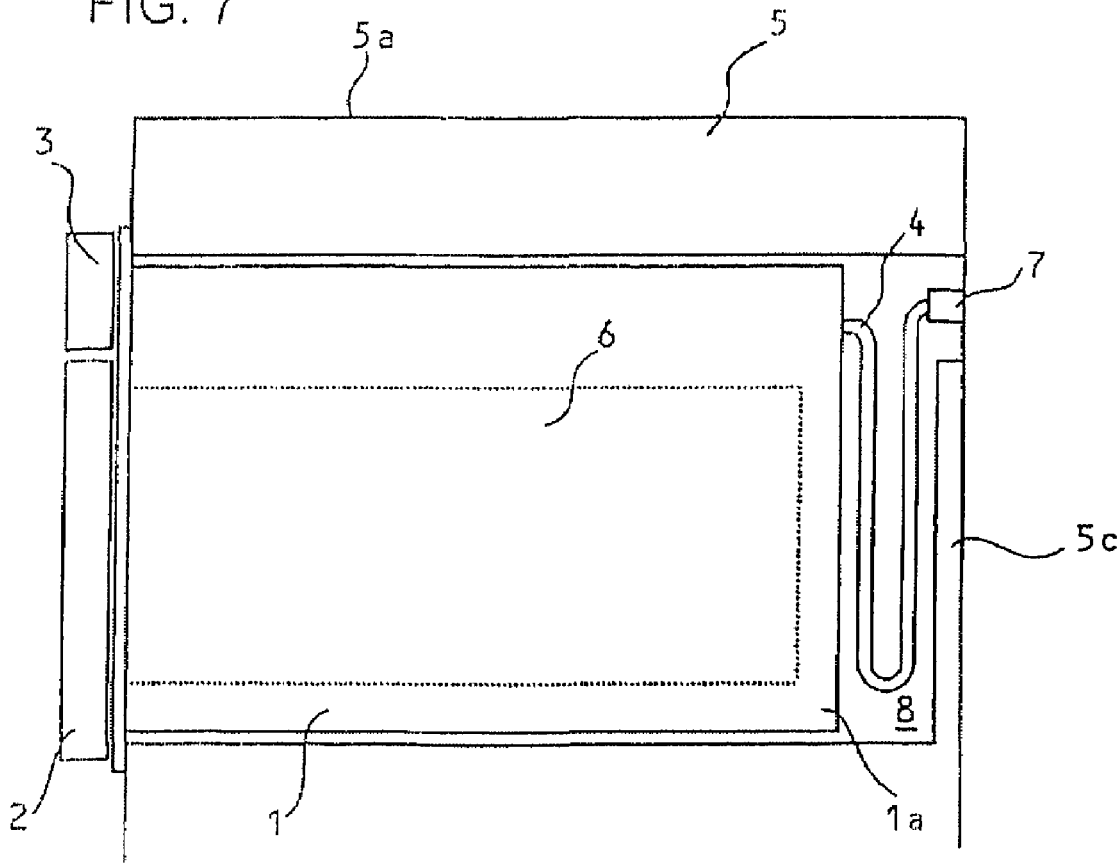
CONVENTIONAL ART FIG. 7
FIG. 7 is a side view of the built-in kitchen apparatus shown in FIG. 6 in an installed state.

The built-in kitchen apparatus shown in FIGS. 1 to 5, in detail, is a pull-out style cooking apparatus, such as a microwave oven, whose heating chamber can be pull-out forward. Since the basic structure of the cooking apparatus according to this embodiment is the same as the structure of a known cooking apparatus shown in FIGS. 6 and 7, the components of the cooking apparatus according to this embodiment that are the same as those of a known cooking apparatus are represented by the same reference numbers and descriptions thereof are not repeated.

Figure 3:
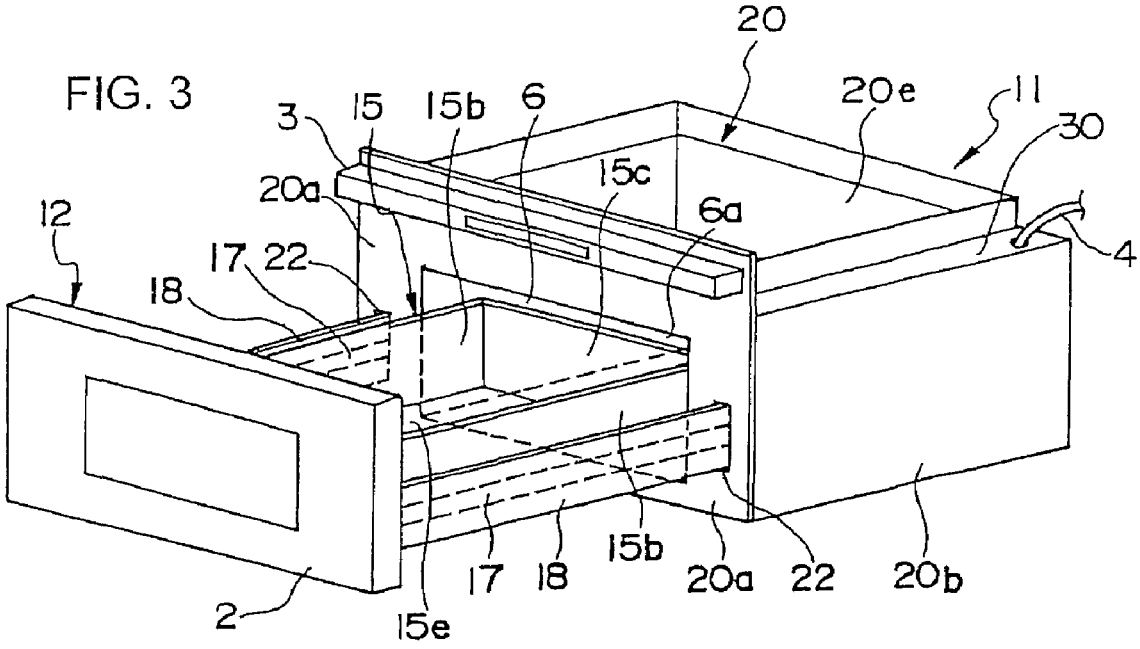
FIG. 3 is a perspective view illustrating the built-in kitchen apparatus shown in FIG. 1, in which the drawer body is pulled out.
Figure 4:
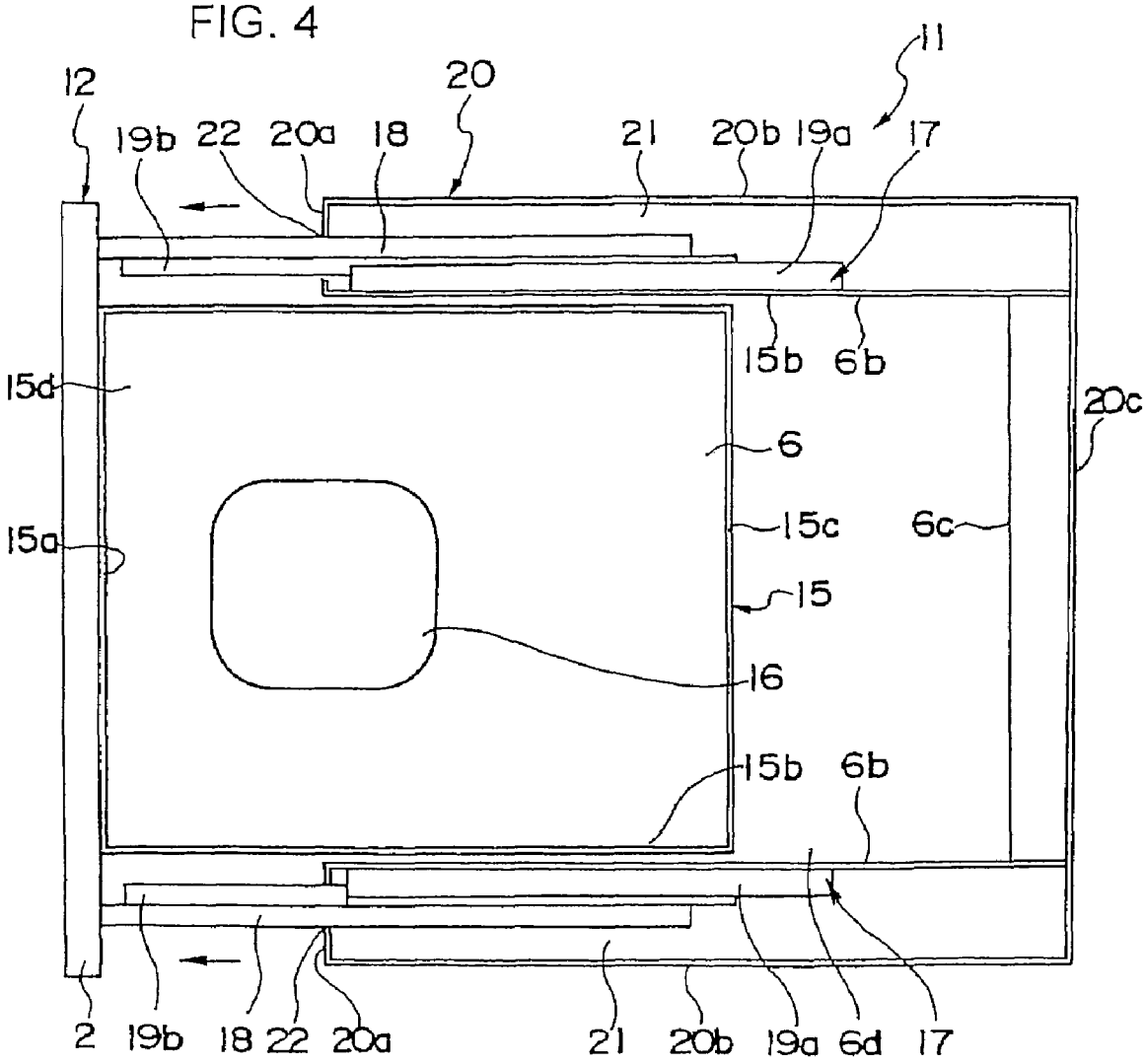
FIG. 4 is a horizontal cross-sectional view illustrating the built-in kitchen apparatus shown in FIG. 1.

A cooking apparatus body 1, as shown in FIGS. 3 and 4, includes a drawer body 12 that can be pulled out from inside of the cooking apparatus body 1. The drawer body 12 includes a heating chamber 6 configured to cook an object to be heated (object to be stored) 16. The heating chamber 6 has an opening on the front surface and is surrounded by left and right sidewalls 6*b* and 6*b*, a rear wall 6*c* connecting to the sidewalls 6*b* and 6*b*, a bottom wall 6*d* connecting to the sidewalls 6*b* and 6*b* and the rear wall 6*c*, and an upper wall.

The drawer body 12 disposed so that it is movably by a slide mechanism, described below, in a manner such that the drawer body 12 can be pulled out from the heating chamber 6 of the cooking apparatus body 1 in the direction indicated by arrows in FIG. 4. The drawer body 12 includes a cover 2 for opening and closing the heating chamber 6 and a heating container 15 to which the cover 2 is attached and in which the object to be heated 16 is placed and stored. The heating container 15 includes left and right side plates 15*b* and 15*b* extending from the left and right of front panels 15*a* and 15*a*, which are attached to the cover 2, a rear panel 15*c* connecting to the side plates 15*b* and 15*b* at the rear (back) side thereof, and a bottom plate 15*d* connecting to the side plates 15*b* and 15*b* and the rear panel 15*c*. A container opening 15*e* for pulling out and pushing in the object to be heated 16 is provided at the upper section of the heating container 15.

The drawer body 12 is movable between a pulled-out position in which the object to be heated 16 is pulled out of the heating chamber 6 and a storage position in which the object to be heated 16 is stored inside the heating chamber 6. The cooking apparatus includes slide rails 17 and 17, configuring a sliding mechanism, to move the drawer body 12 inside the cooking apparatus body 1 and are disposed at the outer left and outer right sides of the heating chamber 6. When the drawer body 12 is at the storage position, the cover 2 is at a closed position in which the cover 2 closes an opening 6*a* of the heating chamber 6. Therefore, the space inside of the heating chamber 6 becomes a vacuum sealed by the inner walls of the cooking apparatus body 1 and the drawer body 12, preventing the microwaves emitted to the inside the heating chamber 6 from leaking outside. When the drawer body 12 is at the pulled-out position, the side plates 15*b* and 15*b* are fully pulled out forward from the heating chamber 6. In this way, the object to be heated 16 can be put in or taken out of the heating container 15 through the container opening 15*e*.

Each of the slide rails 17 and 17 includes a fixed rail 19*a* that is attached to the side of the cooking apparatus body 1 and a movable rail 19*b* that is attached to the side of the drawer body 12 and slidable along the fixed rail 19*a*. The slide rail 17 may have the same structure as a slide rail for a drawer provided for office furniture, such as a cabinet or a desk, and detailed descriptions thereof are omitted here. As shown in FIG. 3 or 4, the fixed rail 19*a* is attached to the outer side of the sidewalls 6*b* and 6*b* constituting the heating chamber 6 of the cooking apparatus body 1. The movable rail 19*b* is attached to the cover 2 with an L-shaped angle member 18 in a manner such that the movable rail 19*b* extends towards the cooking apparatus body 1 from the inner sidewall of the cover 2 of the drawer body 12.

Although not shown in the drawings, inside the cooking apparatus body 1, a microwave generator including a magnetron for generating microwaves and a waveguide for transmitting the microwave are disposed in the vicinity of the heating chamber 6. The microwave generator is disposed in the back area of the heating chamber 6. The microwave generated at the magnetron is transmitted through the waveguide and is emitted into the heating chamber 6 through a feeder.

The left and right slide rails 17 are provided in conjunction with the passage boxes 21 that are provided on the cooking apparatus body 1 on left and right sides of the heating chamber 6. More specifically, the cooking apparatus body 1 includes a chassis 20 that has a front wall 20*a* surrounding the opening 6*a* of the heating chamber 6, left and right sidewalls 20*b* and 20*b*, a rear wall 20*c*, a bottom wall 20*d*, and an upper wall 20*e*. On the cooking apparatus body (microwave oven body) 1, the passage boxes 21 are provided at the outer side of the sidewalls 6*b* and 6*b* of the heating chamber 6 and are surrounded by the sidewalls 20*b* and 20*b*, the front wall 20*a*, the rear wall 20*c*, the bottom wall 20*d*, and part of the upper wall 20*e* of the chassis 20. The fixed rail 19*a* of the slide rail 17 is attached to the outer side of the sidewall 6*b* of the heating chamber 6 in the passage boxes 21. The movable rail 19*b*, together with the L-shaped angle member 18, can be pulled out or pushed into the passage boxes 21 through an insertion hole 22 formed on the front wall 20*a*.

Figure 5:
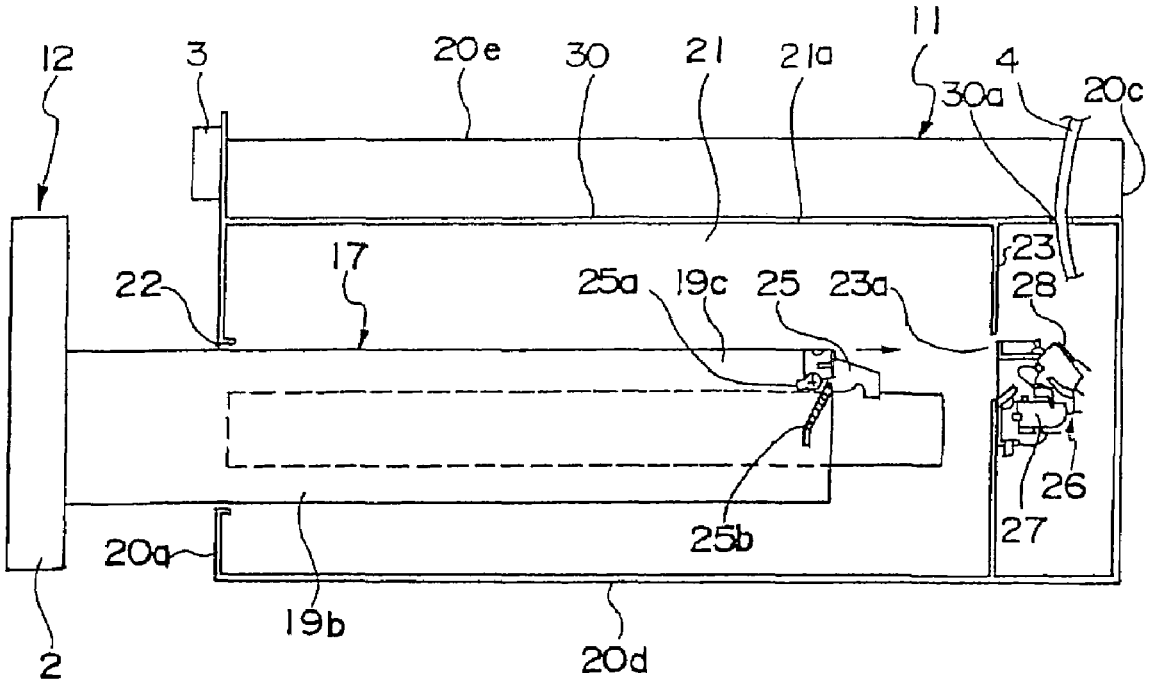
FIG. 5 is cross-sectional side view illustrating a passage box of the built-in kitchen apparatus shown in FIG. 1.

As shown in FIG. 5, at least one of the slide rails 17 and 17 includes an operation lever 25 configured to operate a microwave oscillation stop switch at a rear position of the movable rail 19*b*, or preferably the farthest end 19*c* of the movable rail 19*b*. The operation lever 25 is a movable lever pivotable around a pivoting point 25*a* with respect to the movable rail 19*b*. The operation lever 25 is rotationally urged in a clockwise direction in the drawing with a spring 25*b* and is maintained in the urged state, as shown in the drawing, by a suitable stopper.

Each of the passage boxes 21 has a partition 23 configured to partition the inside of the passage box 21 into sections. The partition 23 has a window 23*a*, where the tip of the operation lever 25 can enter. A switch 26 for stopping the microwave oscillation is provided on the back surface of the partition 23 surrounding the window 23*a* so as to correspond to the position of the operation lever 25 when the fixed rail 19*a* is at the farthest end 19*c*. The switch 26 for stopping the microwave oscillation includes an oscillation switch 27 and a short-circuiting switch 28.

When the drawer body 12 is pushed into the storage position (refer to FIGS. 1 and 2) from a pulled-out position (refer to FIGS. 3 and 5), the switch 26 for stopping the microwave oscillation is turned on by the operation lever 25, which is provided at the farthest end 19*c* of the movable rail 19*b*, entering the window 23*a* of the partition 23. To open the cover 2, the operation lever 25 is released from the switch 26 for stopping the microwave oscillation and returns to the position shown in FIG. 5 to turn off the switch 26. In this way, if the cover 2 is opened after cooking, or even while cooking, the electrical power supply of the microwave generator is turned off, and the generation of microwave is stopped. The heating operation of the cooking apparatus may be controlled by the user by operating other operating switches, not shown in the drawings. The main switch for start cooking is provided separately so the user can control the start of cooking upon his/her intensions.

Returning to FIGS. 1 and 2, a shelf section 30 is formed in a manner such that a shelf section is provided at at least one corner on a side of the upper wall 20*e* of the chassis 20. Accordingly, a storage space 31 capable of accommodating the power cord 4 can be formed between the shelf section 30 of the kitchen apparatus body 1 and the ceiling section 5*b* of the cabinet 5, in the installation state of the drawer body 12 within the cabinet 5 (refer to FIG. 2). The power cord 4 is provided in a manner such that the power cord 4 extends upwards from an opening 30*a* formed at a rear position of the shelf section 30, as shown as a connection part 4*a* to the cooking apparatus body 1. The power cord 4 has a tendency of maintaining the upward-extended state from the opening 30*a* by its rigidity. Therefore, when the cooking apparatus body 1 is installed in the cabinet 5, the power cord 4 can be prevented from hanging downwards and, as described below, can be successfully stored inside the storage space 31. The thickness of the power cord 4 used for the built-in apparatus conforms to a standard, and, for example, in Japan, a 2.0-$mm^2$ or 1.75-$mm^2$ cord may be used, and, in the U.S AWG14 or AWG16 cord may be used.

Figure 1:
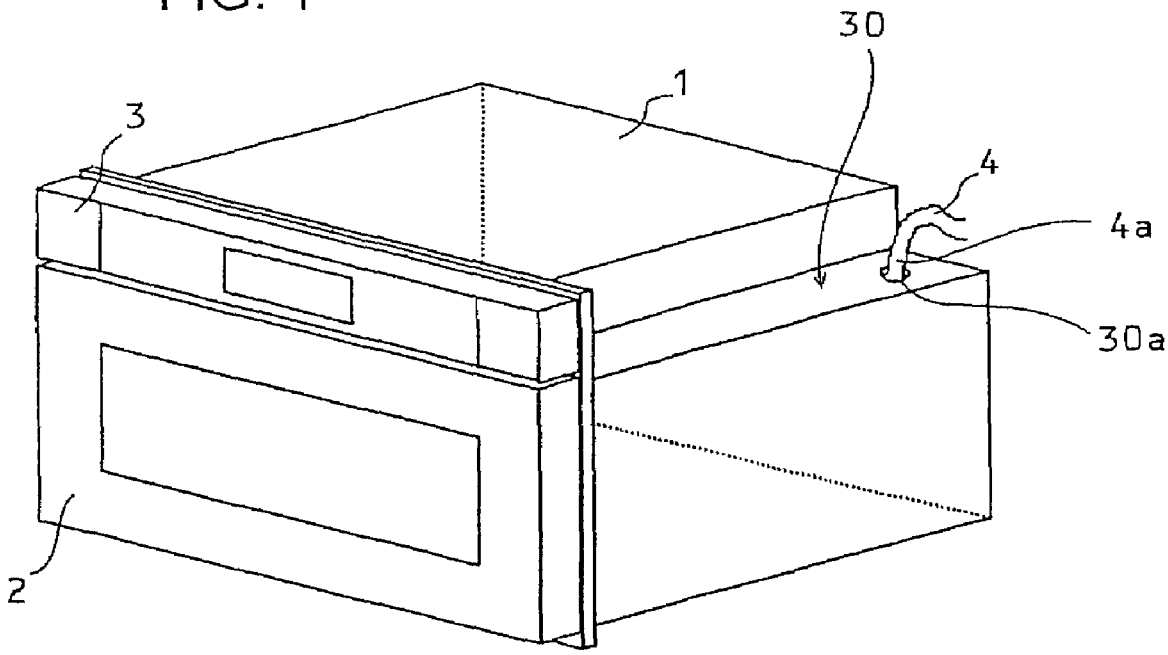
FIG. 1 is a perspective view illustrating the overall exterior of a built-in kitchen apparatus according to an embodiment of the present invention.
Figure 2:
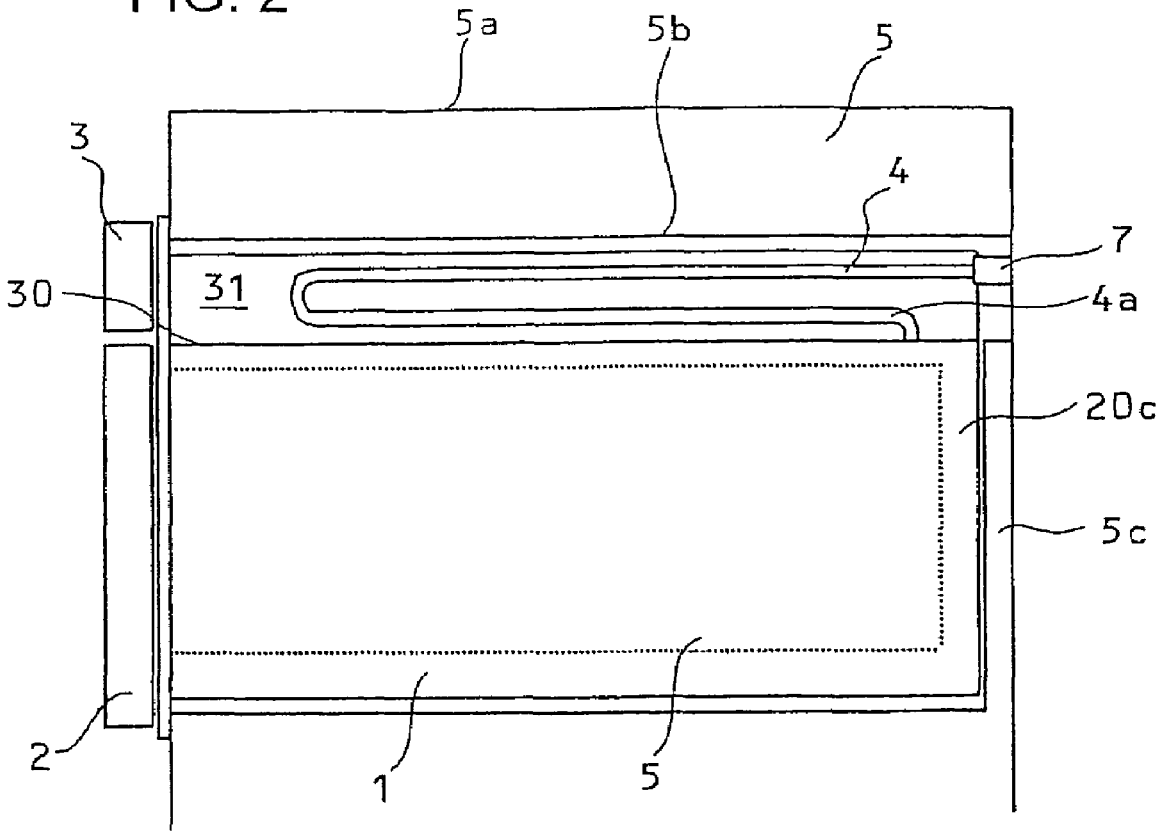
FIG. 2 is a side view of the built-in kitchen apparatus shown in FIG. 1.

When the cooking apparatus body 1 is disposed at a preparation position in the cabinet 5 for installation, the power cord 4 connected to a commercial power supply is extended towards the back of the cabinet 5 to, for example a power outlet, such as the connecting unit 7. However, since the power cord 4 is extended from the opening 30*a* provided at an installation preparation position of the shelf section 30, the length of the power cord 4 can be minimized. Furthermore, as shown in FIG. 2, the power cord 4 extending upwards from the shelf section 30 at the connecting part 4*a* by the rigidity of the power cord 4, is folded in two at substantially the center of the cord and is efficiently stored in a neatly folded fashion in the storage space 31 on the shelf section 30, which has a step-like structure.

Unlike a known power cord, since, during installation, the power cord 4 does not hang downwards from the rear wall 20*c* of the cooking apparatus body 1 and is not caught between the rear wall 20*c* and a back wall 5*c* of the cabinet, the power cord 4 is not damaged. Moreover, since space for accommodating the power cord 4 does not have to be provided between the rear wall 20*c* of the cooking apparatus body 1 and the back wall 5*c* of the cabinet, the depth of the cooking apparatus body 1 is not limited, allowing the cooking apparatus body 1 to have a great depth. As a result, sufficient space can be used for the heating chamber 6. Since the storage space 31 is provided on a side of the chassis 20, a large space can be provided at the center of the cooking apparatus body 1 for storing the object to be heated 16.

The shelf section 30, as most ideally illustrated in FIG. 5, can be provided on an upper wall 21*a* of the passage box 21 configured to accommodate one of the sliding mechanism (slide rail 17) for pulling out the drawer body 12. According to these structures and positions, the space below the shelf section 30 of the cooking apparatus body 1 will not be dead space and may be efficiently used as a passage box 21 configured to accommodate one of the sliding mechanisms used for pulling out the drawer body. As a result, the space of the heating chamber 6 may be maximized.

As a cooking apparatus according to an embodiment of the present invention, a pull-out microwave oven whose drawer body 12 including the heating chamber 6 can be pulled out forward has been described above. However, the kitchen apparatus according to the present invention may be a composite kitchen apparatus having, as a component, at least an integrated pull-out microwave oven unit, wherein the pull-out microwave oven unit includes a drawer body capable of being pulled out forward and a heating chamber. By providing a space for accommodating a power cord on a single pull-out microwave oven or a pull-out microwave oven unit of a composite kitchen apparatus, the space in the heating chamber of the single pull-out microwave oven or the pull-out microwave oven unit, which is a component of the kitchen apparatus, can be increased. It is also, apparent that the present invention is not limited to a pull-out cooking apparatus and may be employed to a cooking apparatus having a swing door or other kitchen apparatuses installed in a cabinet, such as an electric oven and a dish washing and drying machine.

What is claimed is:

1. A built-in kitchen apparatus, comprising:

a kitchen apparatus body capable of accommodating an object to be processed; and a power cord extending from the kitchen apparatus body, the power cord being capable of supplying electric power used for processing the object to be processed, wherein the kitchen apparatus body is installed inside a cabinet from the front side thereof with the power cord connected to the power outlet provided on the back of the cabinet, a shelf section having a step-like depression is provided at at least one corner on a side of an upper wall of the kitchen apparatus body, and a storage space capable of accommodating the power cord is provided between the shelf section and a ceiling section of the cabinet.

2. The built-in kitchen apparatus according to claim 1, wherein the power cord is extended upwards from the kitchen apparatus body from a rear position of the upper wall.

3. The built-in kitchen apparatus according to claim 1, wherein the kitchen apparatus is a pull-out microwave oven including a drawer body having a heating chamber, the drawer body being capable of being pulled out forward.

4. The built-in kitchen apparatus according to claim 1, wherein the kitchen apparatus is a composite kitchen apparatus including a pull-out microwave oven unit including a drawer body having a heating chamber, the pull-out microwave oven unit being a component of the composite kitchen apparatus, the drawer body being capable of being pulled out forward.

5. The built-in kitchen apparatus according to claim 1, wherein, the kitchen apparatus is a pull-out processing device including a drawer body having a processing chamber, the drawer body being capable of being pulled out forward, or a composite kitchen apparatus including a pull-out processing device including a drawer body having a heating chamber, the pull-out microwave oven unit being a component of the composite kitchen apparatus, the drawer body being capable of being pulled out forward, and a space provided below the shelf section of the kitchen apparatus body is used as a passage box configured to accommodate one of a sliding mechanism for pulling out a drawer body.

6. The built-in kitchen apparatus according to claim 1, wherein the power cord is extended upward from the kitchen apparatus body to inside the storage space.

* * * * *